US012196046B2

(12) United States Patent
Sullivan et al.

(10) Patent No.: US 12,196,046 B2
(45) Date of Patent: Jan. 14, 2025

(54) ROLLER SUB FOR REDUCING TORQUE ON A TOOL STRING

(71) Applicant: XConnect, LLC, Denver, CO (US)

(72) Inventors: Shelby L. Sullivan, Minot, ND (US); Joshua M. Scott, Katy, TX (US)

(73) Assignee: XConnect, LLC, Denver, CO (US)

( * ) Notice: Subject to any disclaimer, the term of this patent is extended or adjusted under 35 U.S.C. 154(b) by 0 days.

(21) Appl. No.: 18/533,245

(22) Filed: Dec. 8, 2023

(65) Prior Publication Data

US 2024/0229569 A1 Jul. 11, 2024

Related U.S. Application Data

(60) Provisional application No. 63/478,609, filed on Jan. 5, 2023.

(51) Int. Cl.

| | |
|---|---|
| ***E21B 17/05*** | (2006.01) |
| ***E21B 17/042*** | (2006.01) |
| ***E21B 23/08*** | (2006.01) |
| ***E21B 43/116*** | (2006.01) |

(52) U.S. Cl.

CPC ..... *E21B 17/05* (2013.01); *E21B 17/042* (2013.01); *E21B 43/116* (2013.01); *E21B 23/08* (2013.01)

(58) Field of Classification Search

CPC ..... E21B 17/042; E21B 17/05; E21B 23/08; E21B 43/116

See application file for complete search history.

(56) References Cited

U.S. PATENT DOCUMENTS

| | | | | |
|---|---|---|---|---|
| 3,134,447 | A | 5/1964 | McElya et al. | |
| 3,557,622 | A | 1/1971 | Spangle | |
| 3,722,609 | A | 3/1973 | Kern et al. | |
| 3,964,554 | A | 6/1976 | Ricks et al. | |
| 4,500,094 | A | 2/1985 | Biffle | |
| 5,033,553 | A * | 7/1991 | Miszewski | E21B 43/119 175/4.51 |
| 5,209,309 | A | 5/1993 | Wilson | |
| 5,211,714 | A * | 5/1993 | Jordan | E21B 23/00 166/50 |
| 5,468,153 | A * | 11/1995 | Brown | E21B 17/0285 439/840 |
| 5,927,970 | A | 7/1999 | Pate et al. | |
| 6,039,118 | A | 3/2000 | Carter et al. | |
| 6,047,784 | A | 4/2000 | Dorel | |
| 9,790,748 | B2 * | 10/2017 | Hradecky | E21B 23/14 |

(Continued)

*Primary Examiner* — Shane Bomar

(74) *Attorney, Agent, or Firm* — Peter L. Brewer; Thrive IP

(57) ABSTRACT

A roller sub for reducing torque along a downhole tool string. The roller sub defines a tubular body comprising an elongated shaft. The elongated shaft defines a bore, with the bore receiving an electrical wire or data cable therein. The tubular body also comprises first threads at the first end for engaging a first wellbore tool, and second threads at the opposing second end for engaging a second wellbore tool. The roller sub further comprises a roller body that is releasably clamped onto the elongated shaft of the cylindrical body between a first shoulder and a second shoulder. The roller body defines a second outer diameter that is greater than the first outer diameter and comprises at least two bearing members that permit relative rotational movement between the roller body and the elongated shaft.

19 Claims, 12 Drawing Sheets

(56) References Cited

U.S. PATENT DOCUMENTS

| | | | | |
|---|---|---|---|---|
| D935,574 | S | 11/2021 | Eitschberger et al. | |
| 11,306,556 | B2 | 4/2022 | Price | |
| 11,339,614 | B2 | 5/2022 | Mulhern et al. | |
| 11,492,854 | B2 | 11/2022 | Langford et al. | |
| 11,608,720 | B2 | 3/2023 | Preiss et al. | |
| 11,674,371 | B1 | 6/2023 | Bradley et al. | |
| D994,736 | S | 8/2023 | Sullivan | |
| 11,802,443 | B2 | 10/2023 | Peters | |
| 11,808,093 | B2 | 11/2023 | Eitschberger et al. | |
| 11,846,181 | B2 | 12/2023 | Benson | |
| 2001/0050185 | A1 | 12/2001 | Calder et al. | |
| 2003/0085040 | A1 | 5/2003 | Hemphill et al. | |
| 2004/0021102 | A1 | 2/2004 | Berckenhoff et al. | |
| 2005/0072569 | A1 | 4/2005 | Johnston et al. | |
| 2006/0032673 | A1 | 2/2006 | Young et al. | |
| 2007/0261891 | A1 | 11/2007 | Williams et al. | |
| 2008/0041581 | A1 | 2/2008 | Richards | |
| 2009/0145666 | A1 | 6/2009 | Radford et al. | |
| 2010/0181113 | A1 | 7/2010 | Watson et al. | |
| 2011/0042144 | A1 | 2/2011 | Downton | |
| 2012/0118559 | A1 | 5/2012 | Li et al. | |
| 2012/0145380 | A1* | 6/2012 | Draper | E21B 23/14 166/241.3 |
| 2013/0048623 | A1 | 2/2013 | Jamison et al. | |
| 2013/0340355 | A1 | 12/2013 | Flusche | |
| 2014/0158432 | A1 | 6/2014 | Simpson | |
| 2015/0071794 | A1 | 3/2015 | Zupanick | |
| 2016/0024858 | A1 | 1/2016 | Hanton et al. | |
| 2016/0237752 | A1 | 8/2016 | Jones | |
| 2016/0319651 | A1* | 11/2016 | Willimas | E21B 43/11 |
| 2017/0241209 | A1 | 8/2017 | Benes | |
| 2018/0016846 | A1 | 1/2018 | Peter et al. | |
| 2018/0058167 | A1 | 3/2018 | Finol et al. | |
| 2018/0112465 | A1 | 4/2018 | Ritchie et al. | |
| 2019/0032413 | A1 | 1/2019 | Bomidi et al. | |
| 2019/0242199 | A1 | 8/2019 | Al-Qasim et al. | |
| 2019/0277093 | A1 | 9/2019 | Morin | |
| 2020/0256162 | A1* | 8/2020 | Angelis | E21B 41/00 |
| 2020/0284104 | A1 | 9/2020 | Holmberg et al. | |
| 2020/0308938 | A1* | 10/2020 | Sullivan | E21B 43/119 |
| 2021/0283751 | A1* | 9/2021 | Sullivan | E21B 43/119 |
| 2022/0170348 | A1* | 6/2022 | Bryant | E21B 43/119 |
| 2023/0374876 | A1 | 11/2023 | Moyes | |
| 2023/0392592 | A1 | 12/2023 | Shampine et al. | |
| 2023/0399922 | A1 | 12/2023 | Hussain et al. | |

* cited by examiner

ROLLER SUB FOR REDUCING TORQUE ON A TOOL STRING

STATEMENT OF RELATED APPLICATIONS

The present application claims the benefit of U.S. Ser. No. 63/478,609 filed Jan. 5, 2022. That application was titled "Roller Sub for Reducing Torque On A Tool String."

The '609 application is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the inventions herein. Accordingly, this section should be read in this light, and not necessarily as admissions of prior art.

TECHNICAL FIELD OF THE INVENTION

The present disclosure relates to the field of hydrocarbon recovery operations. More specifically, the present technology relates to a tubular body configured to be placed along a tool string for wellbore operations, wherein the tubular body facilitates the rotational movement of the tubular body relative to the tool string. Further still, the invention relates to a perforating gun assembly having a tubular sub that enables the perforating gun assembly to more easily traverse the long horizontal section of a horizontally-completed wellbore through rotational movement and the release of built-up torque along a wireline.

DISCUSSION OF THE BACKGROUND

In the drilling of an oil and gas well, a near-vertical wellbore is formed through the earth using a drill bit urged downwardly at a lower end of a drill string. After drilling to a predetermined depth, the drill string and bit are removed and the wellbore is lined with a string of casing. An annular region is thus formed between the string of casing and the formation penetrated by the wellbore.

A cementing operation is conducted in order to fill or "squeeze" the annular region with cement along part or all of the length of the wellbore. The combination of cement and casing strengthens the wellbore and facilitates the zonal isolation, and subsequent completion, of hydrocarbon-producing pay zones behind the casing.

In connection with the completion of the wellbore, several strings of casing having progressively smaller outer diameters will be cemented into the wellbore. These will include a string of surface casing, one or more strings of intermediate casing, and finally a string of production casing. The process of drilling and then cementing progressively smaller strings of casing is repeated until the well has reached total depth (or "TD"). In some instances, the final string of casing is a liner, that is, a string of casing that is not tied back to the surface.

Within the last two decades, advances in drilling technology have enabled oil and gas operators to "kick-off" and steer wellbore trajectories from a vertical orientation to a near-horizontal orientation. The horizontal "leg" of each of these wellbores now often exceeds a length of one mile, and sometimes two or even three miles. This significantly multiplies the wellbore exposure to a target hydrocarbon-bearing formation. The horizontal leg will typically include the production casing (or, optionally, a liner).

FIG. 1 is a side, cross-sectional view of a wellbore 100, in one embodiment. The wellbore 100 defines a bore 10 that has been drilled from an earth surface 105 into a subsurface 110. The wellbore 100 is formed using any known drilling mechanism, but preferably using a land-based rig or an offshore drilling rig operating on a platform.

The wellbore 100 is completed with a first string of casing 120, sometimes referred to as surface casing. The wellbore 100 is further completed with a second string of casing 130, typically referred to as an intermediate casing. In deeper wells, that is, wells completed 7,500 feet or more below the earth surface 105, at least two intermediate strings of casing will be used. In FIG. 1, a third string of casing is shown at 140. Together, strings 130, 140 comprise intermediate casing strings.

The wellbore 100 is finally completed with a string of production casing 150. In the view of FIG. 1, the production casing 150 extends from the surface 105 down to a subsurface formation, or "pay zone" 115. As noted, the wellbore 100 is completed horizontally, meaning that a horizontal portion (indicated by leg 156) is provided. The horizontal portion 156 includes a heel 153 and a toe 154. In this instance, the toe 154 defines the TD of the wellbore 100.

It is observed that the annular region, or volume, around the surface casing 120 is filled with cement 125. The cement (or cement matrix) 125 serves to isolate the wellbore 100 from freshwater zones and potentially porous formations around the casing string 120.

The annular volumes around the intermediate casing strings 130, 140 are also filled with cement 135, 145. Similarly, the annular volume around the production casing 150 is filled with cement 155. However, the cement 135, 145, 155 is optionally only placed behind the respective casing strings 130, 140, 150 up to the lowest joint of the immediately surrounding casing string. Thus, a non-cemented annular area 132 is typically preserved above the cement matrix 135, a non-cemented annular area 142 may optionally be preserved above the cement matrix 135, and a non-cemented annular area 152 is frequently preserved above the cement matrix 155.

In order to facilitate the recovery of hydrocarbons, particularly in low-permeability formations 115, the production casing 150 along the horizontal portion 156 undergoes a process of perforating and fracturing (or in some cases perforating and acidizing). Due to the long lengths of new horizontal wells, the perforating and formation treatment process is carried out in multiple stages.

In one method, a perforating gun assembly 200 is pumped down the wellbore 100 towards the toe 154 at the end of a wireline 240. The perforating gun assembly 200 will include a series of perforating guns (shown at 210 in FIG. 2), with each gun having sets of charges ready for detonation. The charges associated with one of the perforating guns 210 are detonated and perforations (not shown) are "shot" into the casing 150. Those of ordinary skill in the art will understand that a perforating gun has explosive charges, typically shaped, hollow, or projectile charges, which are ignited to create holes in the casing 150 (and, if present, the surrounding cement 155) and to pass at least a few inches and possibly several feet into the formation 115. The perforations (not shown) create fluid communication with the surrounding formation 115 such that hydrocarbon fluids can flow from the formation 115, into the casing 150, and up to the surface 105.

After perforating, the operator will fracture (or otherwise stimulate) the formation 115 through the perforations. This is done by pumping treatment fluids into the formation 115 at a pressure above a formation parting pressure. After the fracturing operation is complete, the wireline 240 will be raised from the surface and the perforating gun assembly 200 will be positioned at a new location (or "depth") along the horizontal wellbore 156. A plug (such as plug 112) is set below the perforating gun assembly 200 using a setting tool 160, and new shots are fired in order to create a new set of perforations. Thereafter, treatment fluid is again pumped into the wellbore 100 and into the formation 115. In this way, a second set (or "cluster") of fractures is formed away from the horizontal leg 156 of the wellbore 100.

The process of setting a plug, perforating the casing, and fracturing the formation is repeated in multiple stages until the wellbore 100 has been completed, that is, the wellbore 100 is ready for production.

In FIG. 1, it can be seen that two separate plugs 112 have been placed along the horizontal leg 156 of the wellbore 100. Of course, it is understood that in an actual completion horizontal leg 156 of the wellbore 100 may extend many hundreds or even thousands of feet, with multiple plugs 112 being set between the stages. A string of production tubing (not shown) is then placed in the wellbore 100 to provide a conduit for production fluids to flow up to the surface 105.

In order to provide perforations for the multiple stages without having to pull the perforating gun 200 after every detonation, the perforating gun assembly 200 employs multiple guns 210 arranged in series. FIG. 2 is a side view of an illustrative perforating gun assembly 200, or at least a portion of an assembly. The perforating gun assembly 200 comprises a string of individual perforating guns 210.

Each perforating gun 210 represents various components. These typically include a "gun barrel" 212 which serves as an outer tubular housing. An uppermost gun barrel 212 is supported by an electric wire (or "e-line") 240 that extends from the surface 105 and delivers electrical energy down to the perforating gun assembly 200. Each perforating gun 210 also includes an explosive initiator, or "detonator" (shown in phantom at 229). The detonator 229 is typically a small aluminum housing having a resistor inside. The detonator 229 receives electrical energy from the surface 105 and through the e-line 240, which in turn heats a resistor.

The detonator 229 is surrounded by a sensitive explosive material such as RDX (or hexogen). When an electrical current is run through the detonator 229, a small explosion is set off by the electrically heated resistor. Stated another way, the explosive compound is ignited by the detonator 229. This small explosion sets off an adjacent detonating cord (not shown). When ignited, the detonating cord initiates one or more shots, typically referred to as "shaped charges."

The shaped charges are held in an inner tube, referred to as a carrier tube, for security and discharge through openings 215 in the selected gun barrel 212. As the RDX is ignited, the detonating cord propagates an explosion down its length to each of the shaped charges along the carrier tube.

The perforating gun assembly 200 may include short centralizer subs 220. The perforating gun assembly 200 also includes the inner tubes (referred to as charge carrier tubes), which reside within the gun barrel housings 212 and are not visible in FIG. 2. In addition, tandem subs 225 are used to connect the gun barrel housings 212 end-to-end. Each tandem sub 225 comprises a metal threaded connector placed between the gun barrels 210. (A complete tandem sub is shown at 400 in FIG. 4 of co-owned U.S. Pat. No. 11,293,737, which is incorporated herein in its entirety, by reference.) Typically, the gun barrels 210 will have female-by-female threaded ends while the tandem subs 225 have opposing male threaded ends (indicated at 404 of the parent application).

The perforating gun assembly 200 with its long string of gun barrels (the housings 212 of the perforating guns 210 and the carrier tubes) is carefully assembled at the surface 105, and then lowered into the wellbore 100 at the end of the e-line 240. The e-line 240 extends upward to a control interface (not shown) located at the surface 105. An insulated connection member 230 connects the e-line 240 to the uppermost perforating gun 210. Once the perforating gun assembly 200 is in place within the wellbore 100, the operator of the control interface sends electrical signals to the perforating gun assembly 200 for detonating the shaped charges (seen at 520 in U.S. Pat. No. 11,293,737) and for creating perforations into the casing 150.

As noted in FIG. 1, the setting tool 160 resides at the end of the perforating gun assembly 200. The setting tool 160 may be connected to the lowermost perforating gun 210 by means of a tandem sub 225 and an adapter 162. The setting tool 160 is used to set the plug 112 along the wellbore 100 at a desired depth. This is typically done by using an igniter which initiates the burning of a power charge.

After the casing 150 has been perforated and at least one plug 112 has been set, the setting tool 160 and the perforating gun assembly 200 are removed from the wellbore 100 and a ball (not shown) is dropped into the wellbore 100 to close the plug 112. When the plug 112 is closed, a fluid (e.g., water, water and sand, fracturing fluid, etc.) is pumped by a pumping system down the wellbore 100 (typically through coiled tubing) for fracturing purposes. For a formation fracturing operation, the pumping system will create downhole pressure that is above the formation parting pressure.

As noted, the above operations may be repeated multiple times for perforating and/or fracturing the casing 150 at multiple locations, corresponding to different stages of the well. Multiple plugs 112 may be used for isolating the respective stages from each other during the fracturing phases. When the fracturing of the casing 150 is completed for all stages, the plugs 112 are drilled out and the wellbore 100 is cleaned using a circulating tool.

A problem arises in connection with this multi-stage process. That problem relates to the pumping of the tool strings across the long horizontal section 156 of the wellbore 100. Those of ordinary skill in the art will appreciate that considerable friction occurs between the tool string and the surrounding casing 150. This friction sometimes causes the working string, e.g., a wireline or coiled tubing, to become torqued, or twisted, as it moves the tool string downhole. Thus, a need exists for a tubular sub that may be placed between perforating guns (or other wellbore tool sections) to allow relative rotational movement between the perforating guns and a surrounding casing string. In this way, torque build-up along the wireline is reduced such as by allowing the tool string to spring freely.

SUMMARY OF THE INVENTION

A roller sub is provided herein. The roller sub is designed to be placed in series along a tool string. In one aspect, the tool string comprises a plurality of perforating gun assemblies for perforating a wellbore.

The roller sub is designed to reduce torque along the wireline, particularly as the downhole tool string is being pumped across a deviated section of a wellbore. An example of a deviated section is a horizontal section of a horizontally completed wellbore.

The roller sub first has a tubular body. The tubular body has an elongated shaft having a first end and an opposing second end. The elongated shaft defines a bore extending between the first and second ends, with the bore receiving an electrical wire or data cable.

The tubular body also has first threads provided at the first end for engaging a first wellbore tool, and second threads provided at the opposing second end for engaging a second wellbore tool. A first shoulder resides proximate the first end of the elongated shaft, while a second shoulder resides proximate the second end of the elongated shaft. Of interest, each of the first shoulder and the second shoulder defines a first outer diameter.

The roller sub also comprises a roller body. The roller body has a second outer diameter that is greater than the first outer diameter. The roller body is releasably clamped onto the elongated shaft of the cylindrical body between the first shoulder and the second shoulder. This may be done, for example, through the use of bolts.

Preferably, the roller body comprises an upper portion (or upper half) and a lower portion (or lower half). The upper portion and the lower portion have semi-circular profiles and are configured to be clamped together onto and around the elongated shaft. When clamped together, the upper and lower portions reside between the first shoulder and the second shoulder.

In one embodiment, the first threads of the roller body constitute male threads configured to threadedly engage into an end of an adjoining first wellbore tool. Similarly, the second threads constitute male threads configured to threadedly engage into an end of an adjoining second wellbore tool. Together, the first wellbore tool, the roller sub and the second wellbore tool form a tool string.

In another embodiment, the first threads constitute female threads configured to threadedly engage with an end of a first male-by-male tandem sub. Similarly, the second threads constitute female threads configured to threadedly engage with an end of a second male-by-male tandem sub.

In one aspect, each of the first and second adjoining wellbore tools is a perforating gun, with each perforating gun having a third outer diameter. In this instance:

- the first threads may constitute female threads configured to threadedly engage with a first end of a first male-by-male tandem sub;
- a second end of the first male-by-male tandem sub is connected to a first perforating gun;
- the second threads constitute female threads configured to threadedly engage with a second end of a second male-by-male tandem sub;
- a second end of the second male-by-male tandem sub is connected to a second perforating gun; and
- each of the first perforating gun and the second perforating gun has a third outer diameter; with the second outer diameter being larger than the third outer diameter.

In one aspect, the roller body comprises at least two bearing members along an inner diameter. The bearing members engage the roller body and permit relative rotational movement between the roller body and the elongated shaft of the tubular body. In this way, the roller sub and connected tool string can turn, or rotate within a surrounding casing string.

In an alternative aspect, each of the upper portion and the lower portion of the roller body comprises a series of semi-circular disks placed in series. In addition, each of the upper portion and the lower portion comprises a series of openings, with the openings in the upper portion being aligned with the openings in the lower portion. The roller sub further comprises a plurality of bolts configured to be received within the openings in the upper portion and the lower portion, and to secure the upper portion to the lower portion.

A method of running a tool string such as a perforating gun assembly into a wellbore using the roller sub is also provided.

BRIEF DESCRIPTION OF THE DRAWINGS

So that the manner in which the present disclosures can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DEFINITIONS

Figure 1:
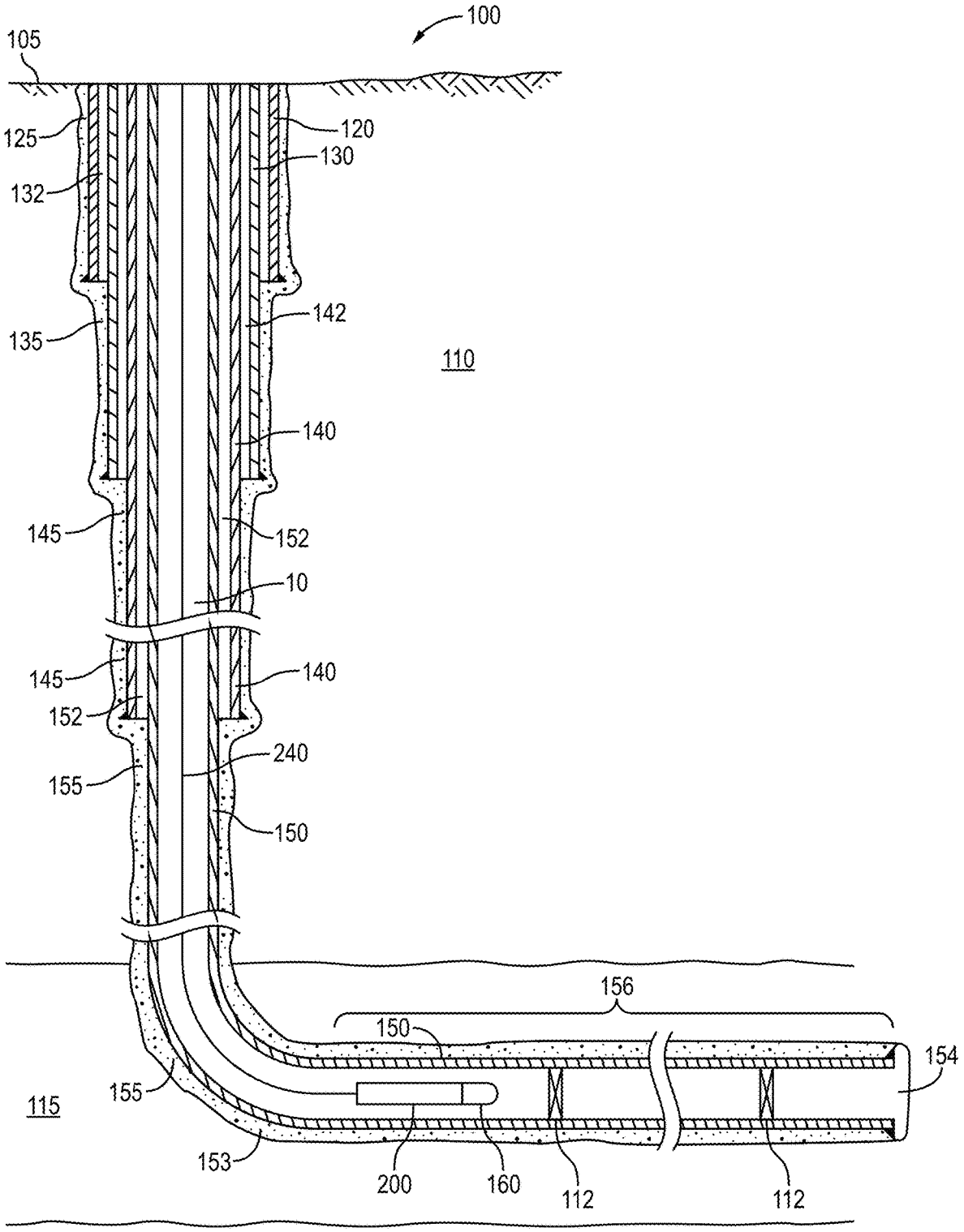
FIG. 1 (Prior Art)
FIG. 1 is a cross-sectional side view of a wellbore. The wellbore is being completed with a horizontal leg. A perforating gun assembly is shown having been pumped into the horizontal leg at the end of an e-line.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, carbon dioxide, and/or sulfuric components such as hydrogen sulfide.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, nitrogen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids as a slurry.

As used herein, the term "surface" refers to a location on the earth's surface. The surface may be a land surface or a water surface.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation: (i) the creation, generation and/or entrapment of hydrocarbons or minerals, and (ii) the execution of processes used to extract hydrocarbons or minerals from the subsurface region.

As used herein, the term "wellbore" refers to a hole in the subsurface made by drilling or insertion of a conduit into the subsurface. A wellbore may have a substantially circular cross-section, or other cross-sectional shapes. The term "well," when referring to an opening in the formation, may be used interchangeably with the term "wellbore."

As used herein, the term "sub" generally refers to a tubular body. The sub may have opposing threaded ends and is used to connect tubular bodies in series.

Reference herein to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment.

DETAILED DESCRIPTION OF CERTAIN EMBODIMENTS

The following description of the embodiments refers to the accompanying drawings. The same reference numbers in different drawings identify the same or similar elements. The following detailed description does not limit the invention; instead, the scope of the invention is defined by the appended claims.

The present invention relates to a roller sub useful for moving a downhole tool through a horizontal (or otherwise deviated) portion of a wellbore. The roller sub generally comprises two components: (1) a tubular body (seen at 300 in FIGS. 3A and 3B), and (2) a roller body (seen at 500 in FIG. 5A). Together, the tubular body 300 and the roller body form a roller sub (shown at 600 in FIG. 6B).

Figure 3A:
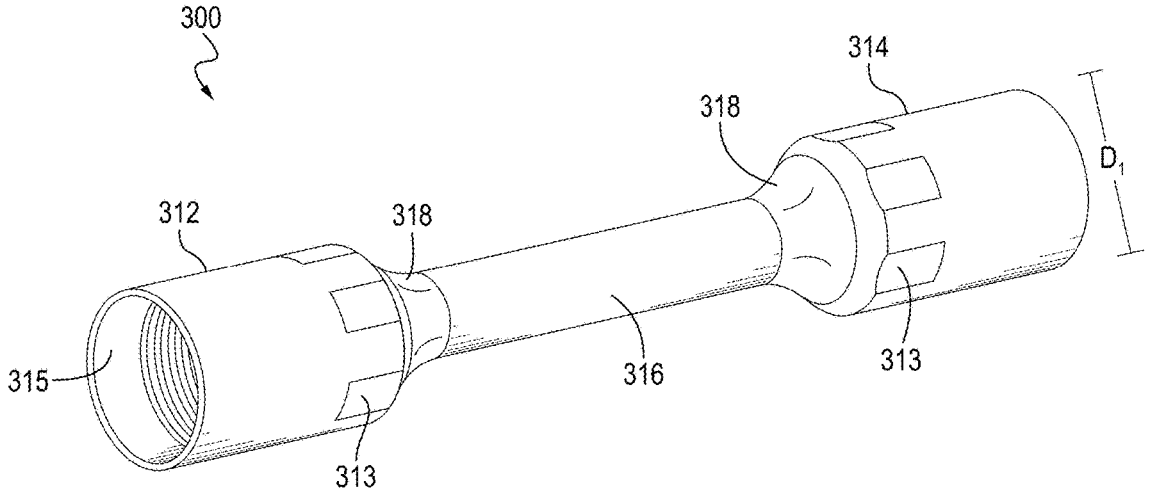
FIG. 3A is a side view of a portion of a tubular sub for connecting perforating guns end-to-end. In this view, only a supporting tubular body is shown.

FIG. 3A is a perspective view of the tubular body 300 referenced above. The tubular body 300 forms a portion of the roller sub 600. The tubular body 300 serves two purposes. First, the tubular body 300 provides support for holding the roller body 500 along a tool string. Second, the tubular body 300 offers threaded ends 312, 314 used to connect two perforating guns end-to-end, forming a tool string.

Figure 3B:
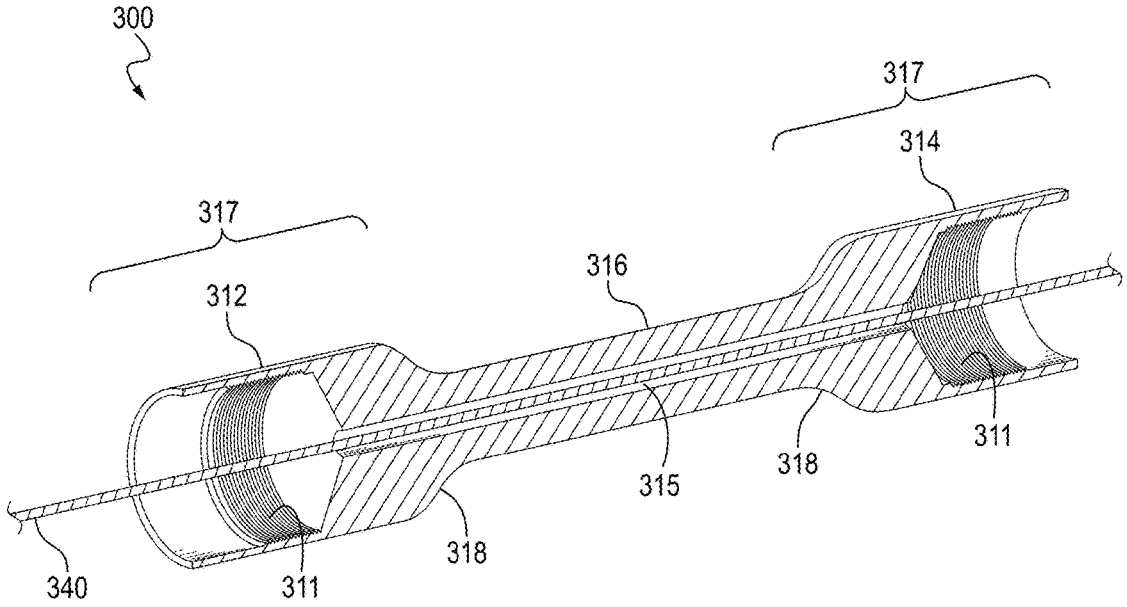
FIG. 3B is a cut-away view of the tubular sub of FIG. 3A. Here, an inner bore of the tubular sub is shown.

FIG. 3B is a cut-away view of the tubular body 300 of FIG. 3A. Here, an inner bore 315 of the tubular body 300 is shown. The tubular body 300 will be discussed with reference to FIGS. 3A and 3B together.

The tubular body 300 defines a generally tubular body having a first end 312 and an opposing second end 314. Each end 312, 314 represents a threaded connector. Threads are shown in FIG. 3B at 311. Preferably, each end 312, 314 defines female threads 311 for receiving male threads from an adjoining wellbore tool or connector sub (such as tandem sub 225 of FIG. 2). In addition, each of the first and second ends 312, 314 has a first outer diameter $D_1$.

The first 312 and second 314 ends, with their threads 311, form couplings 317. In one aspect, each coupling 317 extends inward from the threads about one to four inches. Flat surfaces (or "flats") 313 may be placed around the couplings 317 for use in connecting and subsequently tightening (i.e., "torquing") the sub 300 onto an adjoining tandem sub (as shown at 225 of FIG. 4).

The tubular body 300 also comprises an elongated shaft 316. The elongated shaft 316 extends between the first 312 and the second ends 314 forming a part of the tubular body. Of interest, the shaft 316 has a second outer diameter that is smaller than the first outer diameter. The outer diameter (or O.D.) minimum is limited by the bending stress applied when picking up the tool string 400 from horizontal to vertical.

The shaft 316 and opposing couplings 317 may be fabricated from a high strength steel. Alternatively, the shaft 316 and couplings 317 may comprise titanium, beryllium, or copper. Combinations of these materials, forming an alloy, may also be used. Preferably, the shaft 316, or more specifically the material comprising the shaft 316, has a modulus of elasticity that allows the shaft 316 to deform as it is pumped across or pulled out of the heel 153 of a wellbore 100, and allowing the shaft 316 to return to its original shape.

The tubular body 300 optionally comprises a pair of transition sections 318. Each transition section 318 resides between the shaft 316 and the opposing first 312 or second end 314. Each transition section 318 is about one to four inches in length. Preferably, the shaft 316 represents 40% to 70% inclusive of the end-to-end length of the tubular body 300. The remaining length is the couplings 317, that is, the transition sections 318 and the ends 312, 314.

The tubular body 300 is configured to slidably receive a data cable or an electrical wire 340 for the transmission of signals, data or power. In this regard, the bore 315 of the tubular body 300 has a bore 315 configured to receive the cable or wires 340. A smaller inside diameter for bore 315 is preferred to closely hold the cable or wires 340.

Figure 2:
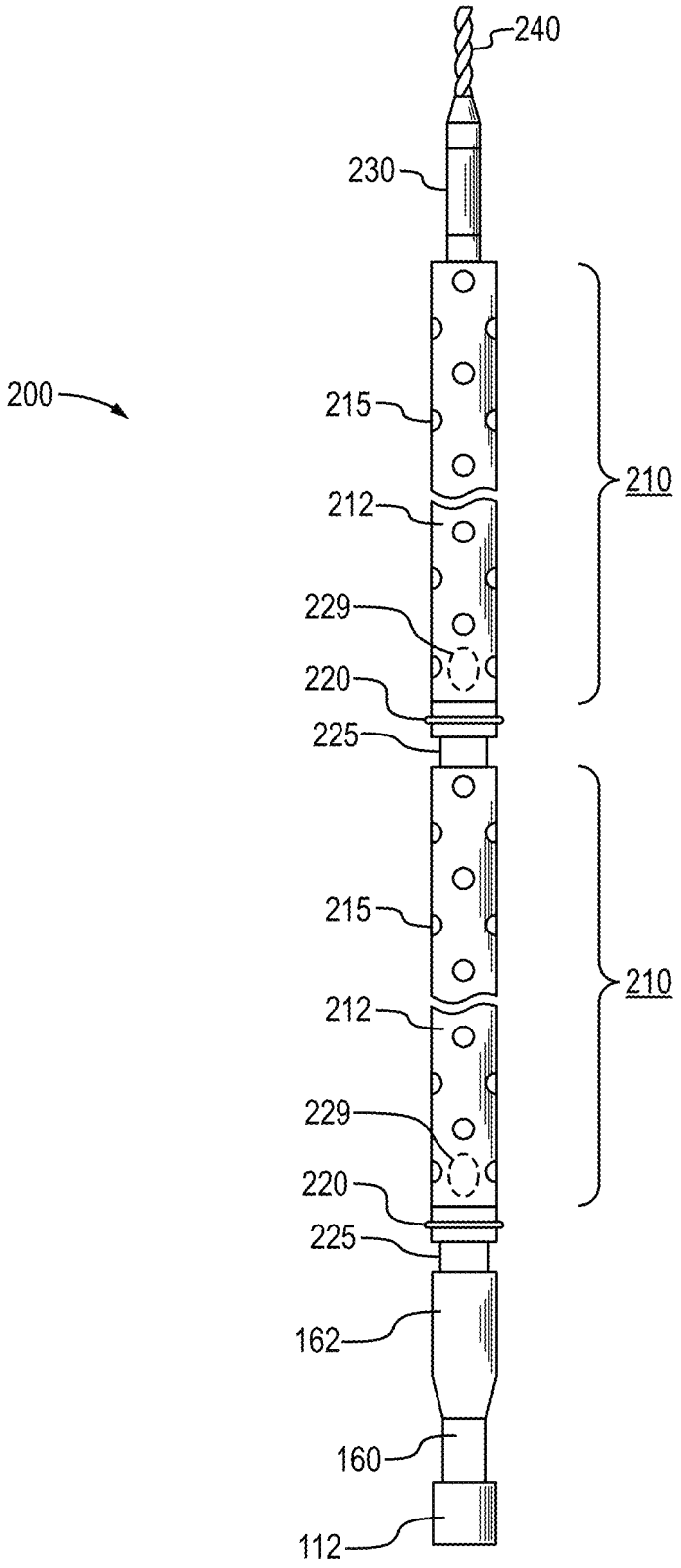
FIG. 2 (Prior Art)
FIG. 2 is a side view of a perforating gun assembly. The perforating gun assembly represents a series of perforating guns having been threadedly connected end-to-end. Tandem subs are shown between gun barrels of the perforating guns, providing threaded connections.

The tubular body 300 is designed to reside along an otherwise rigid string of tools, such as the gun barrel assembly 200 of FIG. 2. In a preferred embodiment, the flexible tubular body 300 is threadedly placed between two perforating guns, such as perforating guns 210 of FIG. 2. Traditional gun barrels (the rigid housings 212 of the perforating guns 210) are female-by-female, with the connecting tandem subs 225 being male-by-male, meaning that each end of a tandem sub 225 has male threads. With this in mind, the tubular sub 300 may be used as an in-line replacement for any typical gun barrel by using the same female-by-female threaded ends.

Of course, the same ends 312, 314 of the tubular sub 300 may be made with any combination of threads, such as male-by-female. Instead of replacing just a gun barrel, the operator may instead replace both a gun barrel and a sub together and then use a tubular sub 300 having male-by-female threaded ends. However, with the female-by-female design, no additional insulators, conductors, contact pins, or springs are required, as the design may utilize the existing gun wire and bulkheads to pass electrical continuity through the bore 315 downhole as the replaced gun barrel would.

Figure 4:
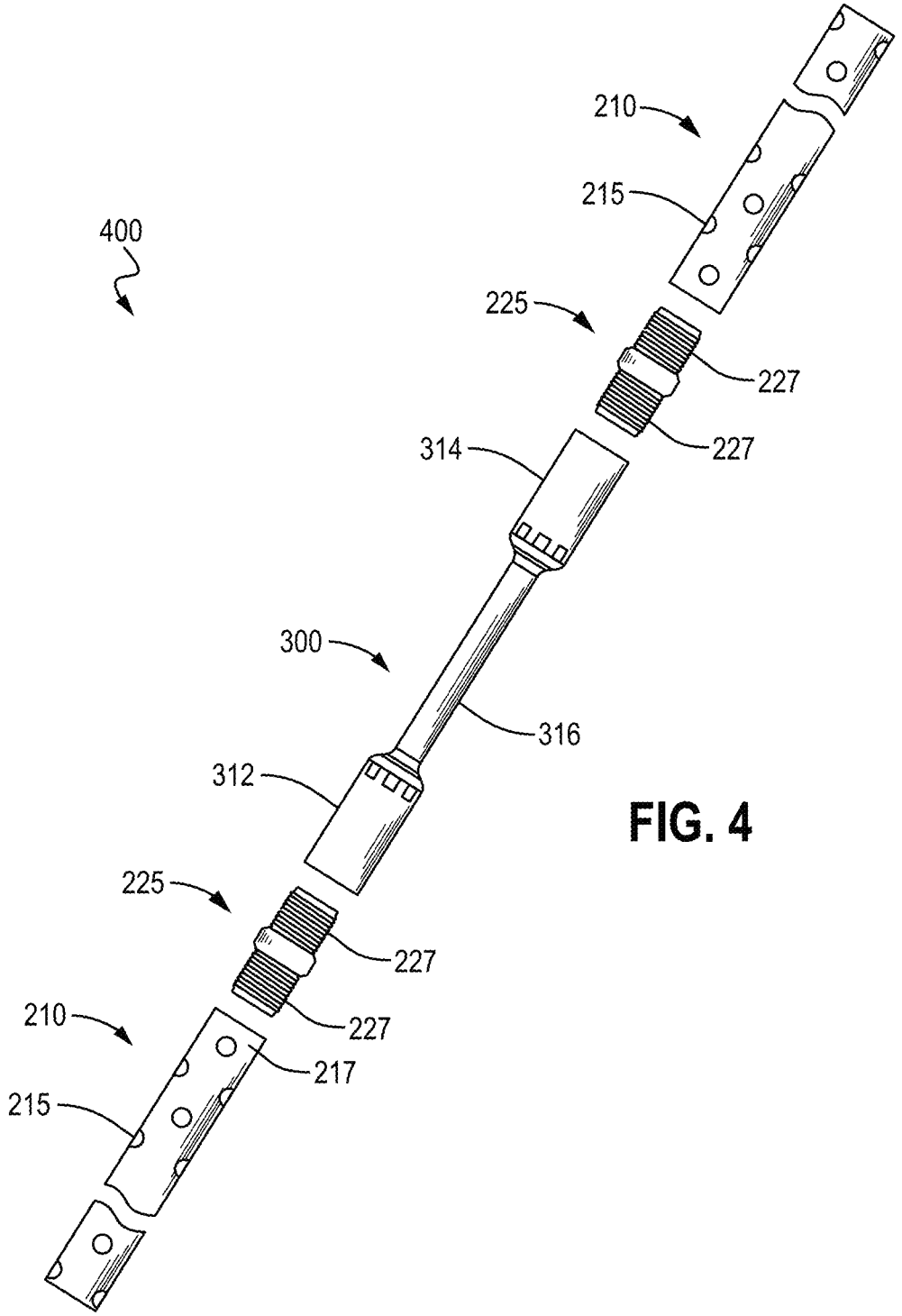
FIG. 4 is an exploded, side view of the tubular sub of FIGS. 3A and 3B. Here, the tubular sub is shown between opposing tandem subs of a perforating gun assembly.

FIG. 4 is an exploded, side view of the tubular body 300 of FIGS. 3A and 3B. Here, the tubular body 300 is shown between opposing tandem subs 225 of a perforating gun assembly 400. The perforating gun assembly 400 may be in accordance with the perforating gun assembly 200 as shown in FIG. 2. In this instance, the perforating gun assembly 400 comprises tandem subs 225, perforating guns 210, and the tubular body 300. Of course, the perforating gun assembly 400 may comprise additional elements when used downhole, such as additional tandem subs 225 and perforating guns 210 to form a complete tool string.

In this view, the tandem subs 225 are shown in greater illustrative detail and are exploded away from the tubular body 300, revealing male threaded ends 227. The male threaded ends 227 thread directly into respective female threaded ends 312, 314 (or couplings 317) of the tubular body 300.

In addition to the tandem subs 225, perforating guns 210 are shown in an exploded view away from opposing ends of the tubular body 300. In this arrangement, the tubular body 300 is connected to the perforating guns 210 by means of the tandem subs 225.

Each tandem sub 225 has a male threaded end 227 on each end of the tandem sub 225. One male end 227 of a tandem sub 225 connects to a female end, e.g., end 312, of the tubular body 300, while the other male end 227 of the tandem sub 225 connects to a female end 217 of the perforating gun 210. In essence, the tubular body 300 serves as a flexible, "blank" perforating gun in a perforating gun assembly.

The tubular body 300 preferably has a length of between five and twelve inches. In one aspect, the tubular body 300 has an overall length that matches or approximates the length of the gun barrels 210 used in the perforating gun assembly (i.e., tool string) 200. For example, if there are 16-inch long gun barrels being used, the tubular body 300 will also be 16 inches from end 312 to end 314. Of course, the length of the tubular body 300 may be longer or shorter than the gun barrels 210. However, the longer the length of the tubular body 300, the more flex/deviation the body 300 will offer, allowing the operator to navigate through more highly deviated wellbores 100.

As noted above, the inner bore 315 of the tubular body 300 serves as an internal chamber that permits wires and/or data cables 340 to travel down the tool string 200 en route to a next perforating gun 210 downhole. The wires or data cables 340 extend through the perforating gun assembly 400, transmitting detonation signals one perforating gun 210 at a time. When a detonation signal is received from the wireline 240, electronics inside the tandem sub 225 initiate the detonation of the immediately-upstream perforating gun 210.

In one unique embodiment, certain electronics are stored in the tandem sub 225 rather than in the perforating gun housing (i.e., gun barrel) 212. The adjoining tandem sub 225 holds a seal mechanism (not shown) that is designed to pressure seal the downstream end of the bore of the sub 225. In this way, detonation of the shaped charges of a downstream perforating gun 210 does not damage the electronics inside the tandem sub 225. An illustrative arrangement for a seal mechanism is presented in co-owned U.S. Pat. No. 11,402,190. This patent is entitled "Detonation System Having Sealed Explosive Initiation Assembly" and is incorporated herein in its entirety by reference.

Figure 5A:
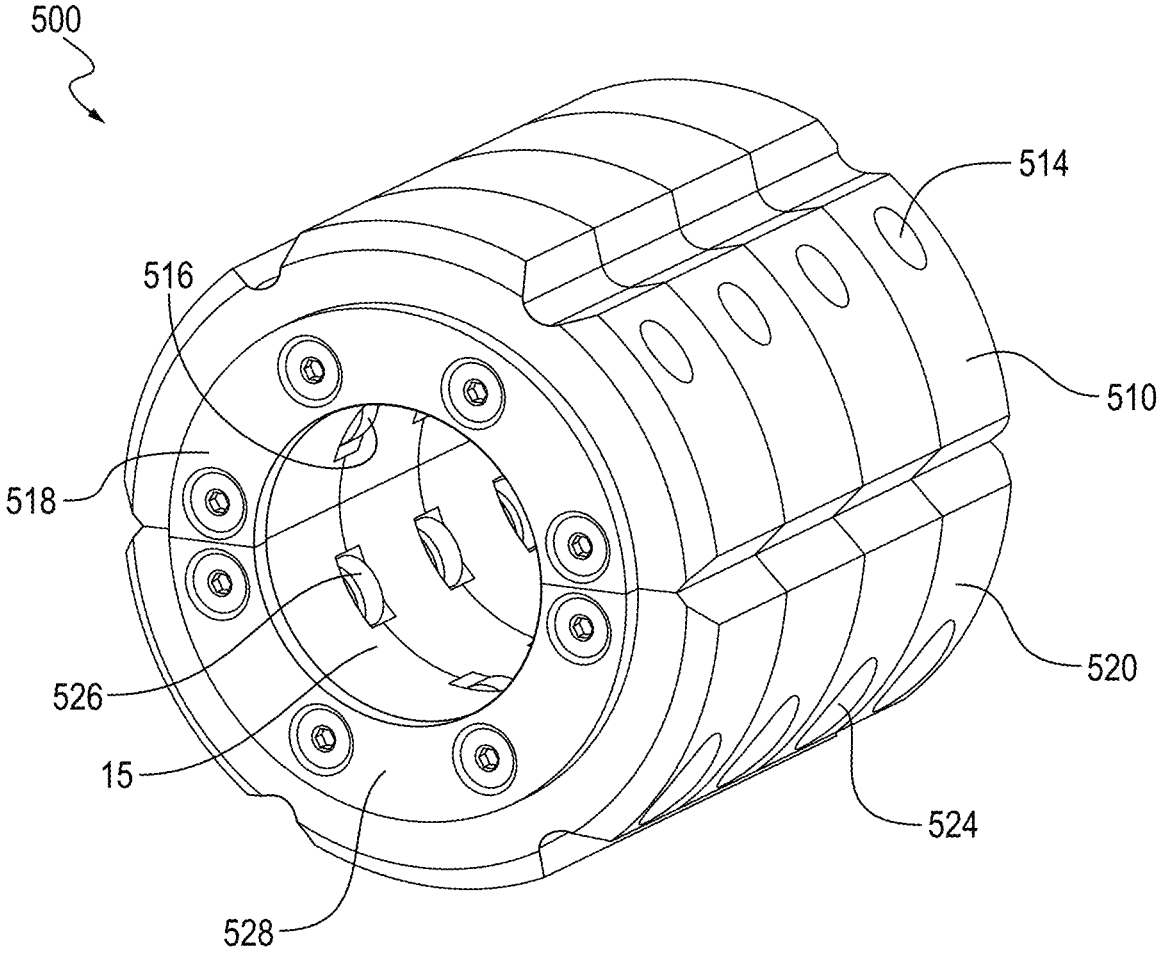
FIG. 5A is a perspective view of a roller body of the present invention, in one embodiment. Here, opposing halves of the roller body have been placed together, preserving a central bore.

FIG. 5A is a perspective view of the roller body 500 of the present invention, in one embodiment. Here, opposing halves 510, 520 of the roller body 500 have been placed together, forming a cylindrical body. FIG. 5C is a cut-away view of the roller body 500 of FIG. 5A. The roller body 500 has been cut through a vertical axis, leaving half of each of the opposing halves 510, 520. The roller body 500 will be discussed further with reference to FIGS. 5A and 5C together.

The opposing halves 510, 520 may be referred to herein as an upper half 510 and a lower half 520. The upper half 510 is comprised of a series of semi-circular discs 512 placed side-by-side. Similarly, the lower half 520 is comprised of a series of semi-circular discs 522 placed side-by-side. Residing between the semi-circular discs 512 of the upper half 510 are bearing members 516. Reciprocally, residing between the semi-circular discs 522 of the lower half 520 are bearing members 526. Together, the bearing members 516, 526 permit relative rotational movement between the elongated shaft 316 and the surrounding roller body 500.

Semi-circular end plates 518 are placed at opposing ends of the upper half 510 of the roller body 500. Similarly, semi-circular end plates 528 are placed at opposing ends of the lower half 520 of the roller body 500. Pins 519, 529 extend through longitudinal lengths of the upper half 510 and the lower half 520 in order to secure the semi-circular discs 512, 522 together and in place.

It is understood that other equally effective bearing arrangements may be used in place of the small rollers shown as bearing members 516, 526. For example, one or more of the semi-circular discs 512, 522 could be configured to rotate within the roller body 500. In this arrangement, such semi-circular discs would have a smaller I.D. than the other semi-circular discs.

It is necessary to secure the upper half 510 of the roller body 500 to the lower half 520. To this end, bolts (shown at 530 in the translucent views of FIGS. 7A and 7B) may be placed within openings within the roller body 500. Openings 514 are placed within the upper half 510 of the roller body 500. Likewise, openings 524 are placed within the lower half 520 of the roller body 500. Openings 514 and 524 are aligned in order to receive the bolts 530.

Figure 5B:
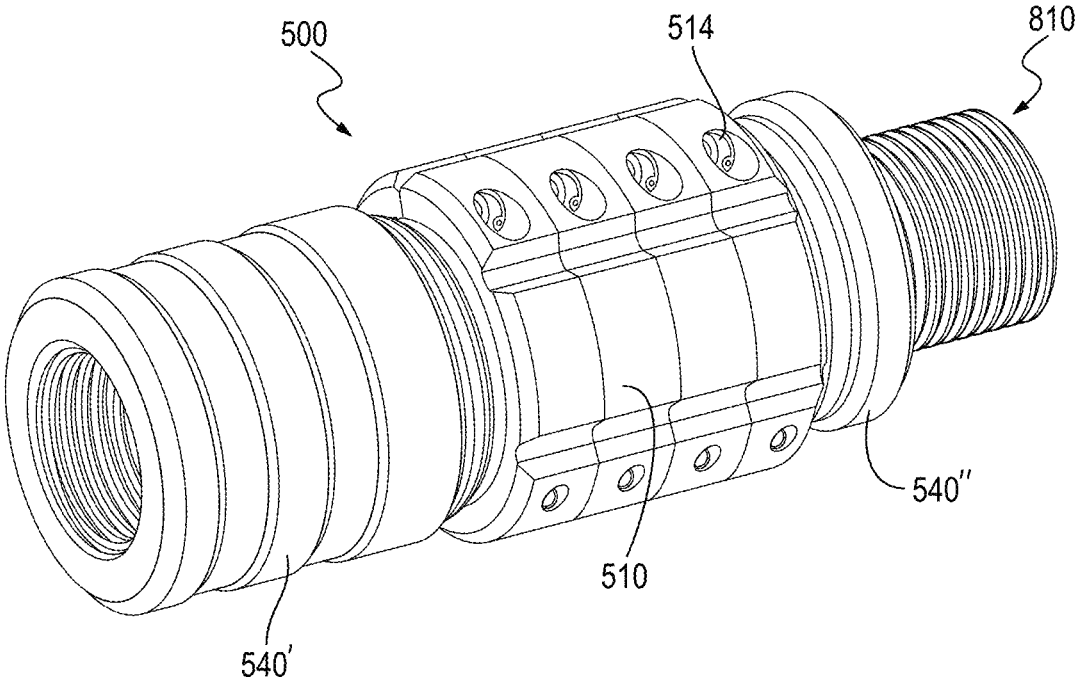
FIG. 5B is a perspective view of a roller body of the present invention.
Figure 5C:
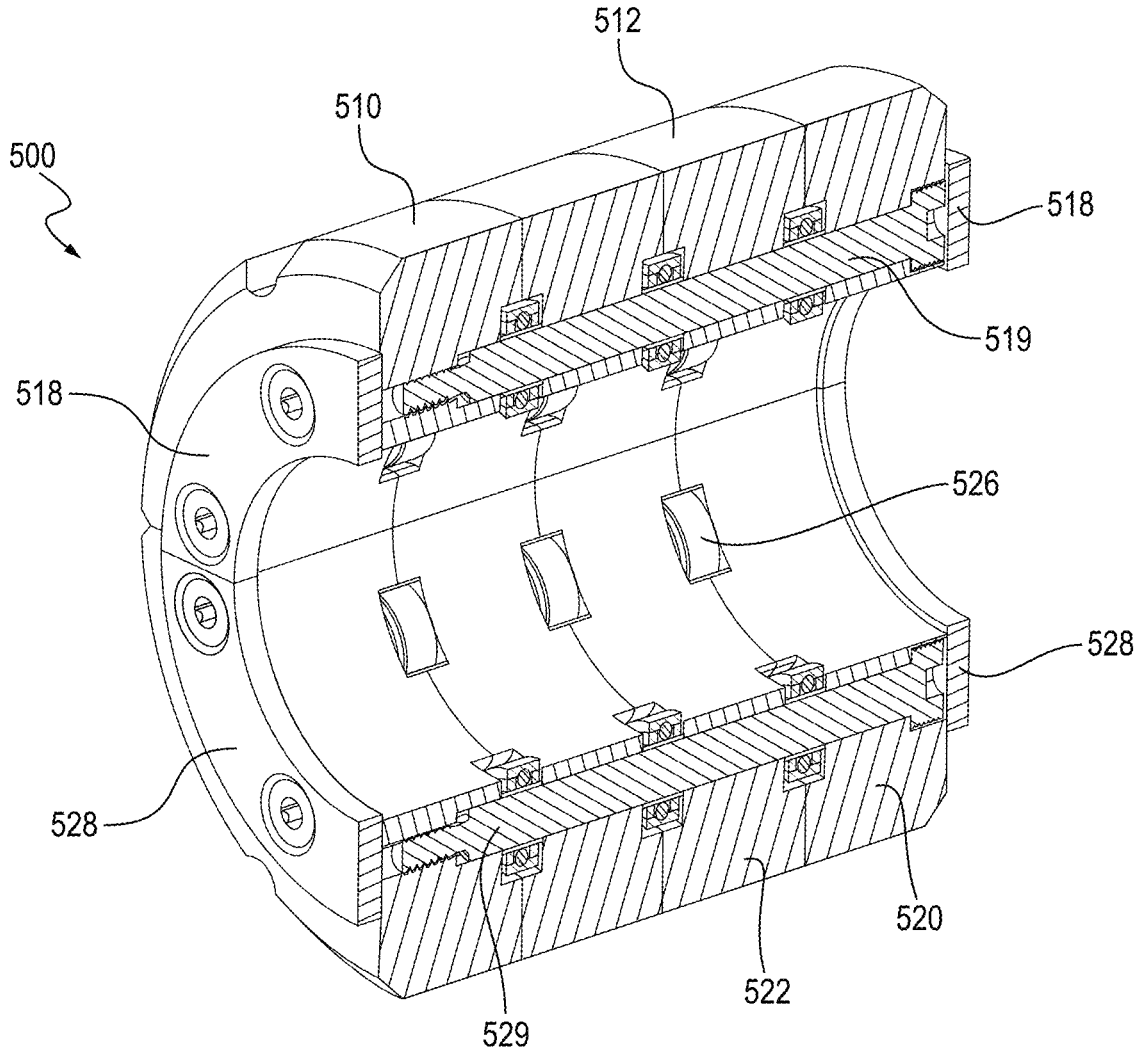
FIG. 5C is a cut-away view of the roller body of FIG. 5A. Roller bearings are revealed extending into the central bore. Half of an upper portion and half of a lower portion are visible.

FIG. 5B is a perspective view of the roller body 500 of FIG. 5A. In this arrangement, weights have been placed along threads that are part of a downhole tool (such as tool 810 of FIG. 8A). The one or more weights are eccentric to, or decentralized from, the downhole tool 810. Weights 540' are placed upstream of the roller body 500, while weight 540" is placed downstream of the roller body 500.

When the downhole tool 810 resides between two roller bodies 500, the downhole tool 810 will rotate, or swing, into a position where the one or more weights reside at the bottom of the horizontal section 156 of the wellbore 100. Where the downhole tool 810 is a perforating gun, the one or more weights may be an elongated orienting weight bar. More preferably, the weight bar is a separate body threadedly connected in series with the tool string 800.

Figure 6A:
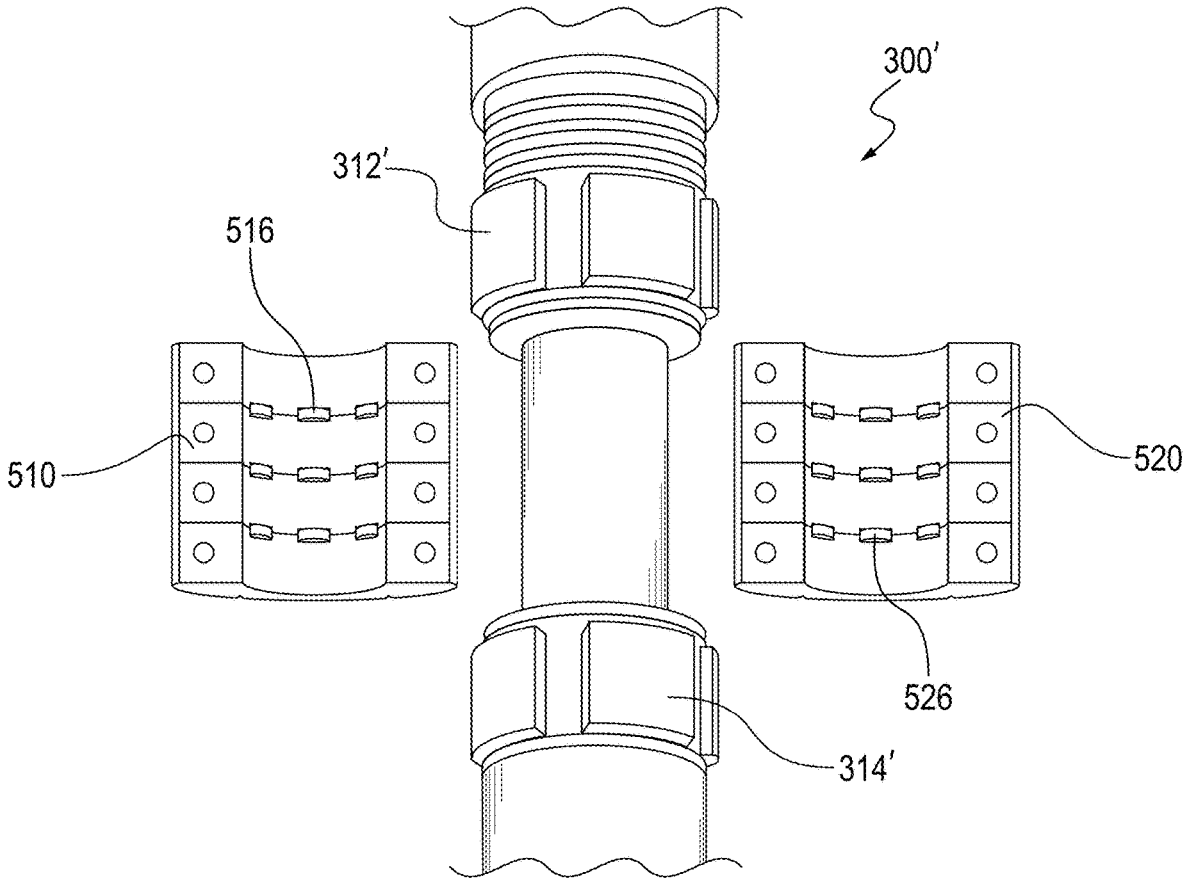
FIG. 6A is a side, perspective view of a tubular sub in an alternate arrangement. Here, opposing halves of a roller body have been removed from the elongated shaft of the tubular body (or roller sub).

FIG. 6A is a side, perspective view of a tubular body 300' in an alternate arrangement. The tubular body 300' has a first end 312' and an opposing second end 314'.

Here, opposing halves of the roller body 500 have been removed from opposite sides of the elongated shaft 316 of the tubular body 300'.

Figure 6B:
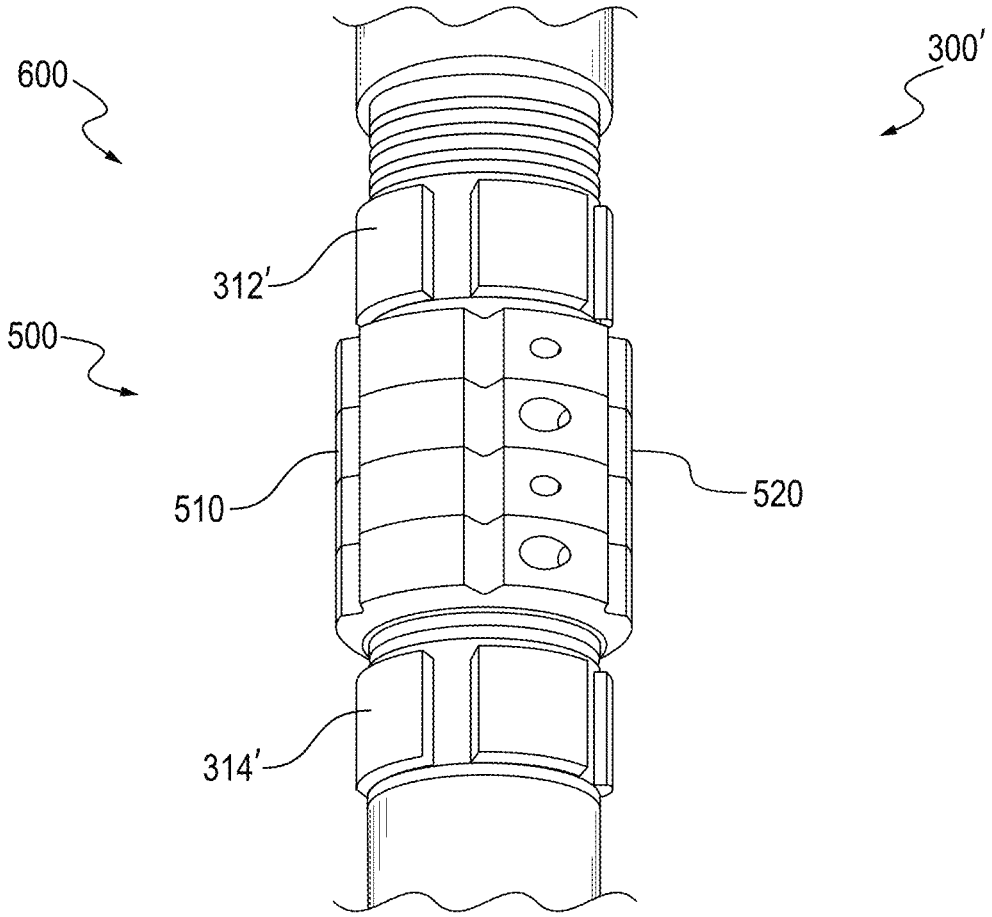
FIG. 6B is another side view of the tubular sub of FIG. 6A. Here, the opposing halves of the roller body have been connected to each other, surrounding the elongated shaft.

FIG. 6B is another side view of the tubular body 300' of FIG. 6A. Here, opposing halves 510, 520 of the roller body 500 have been connected to each other, surrounding the elongated shaft 316. Together, the tubular body 300' and the roller body 500 form a roller sub 600.

Figure 7A:
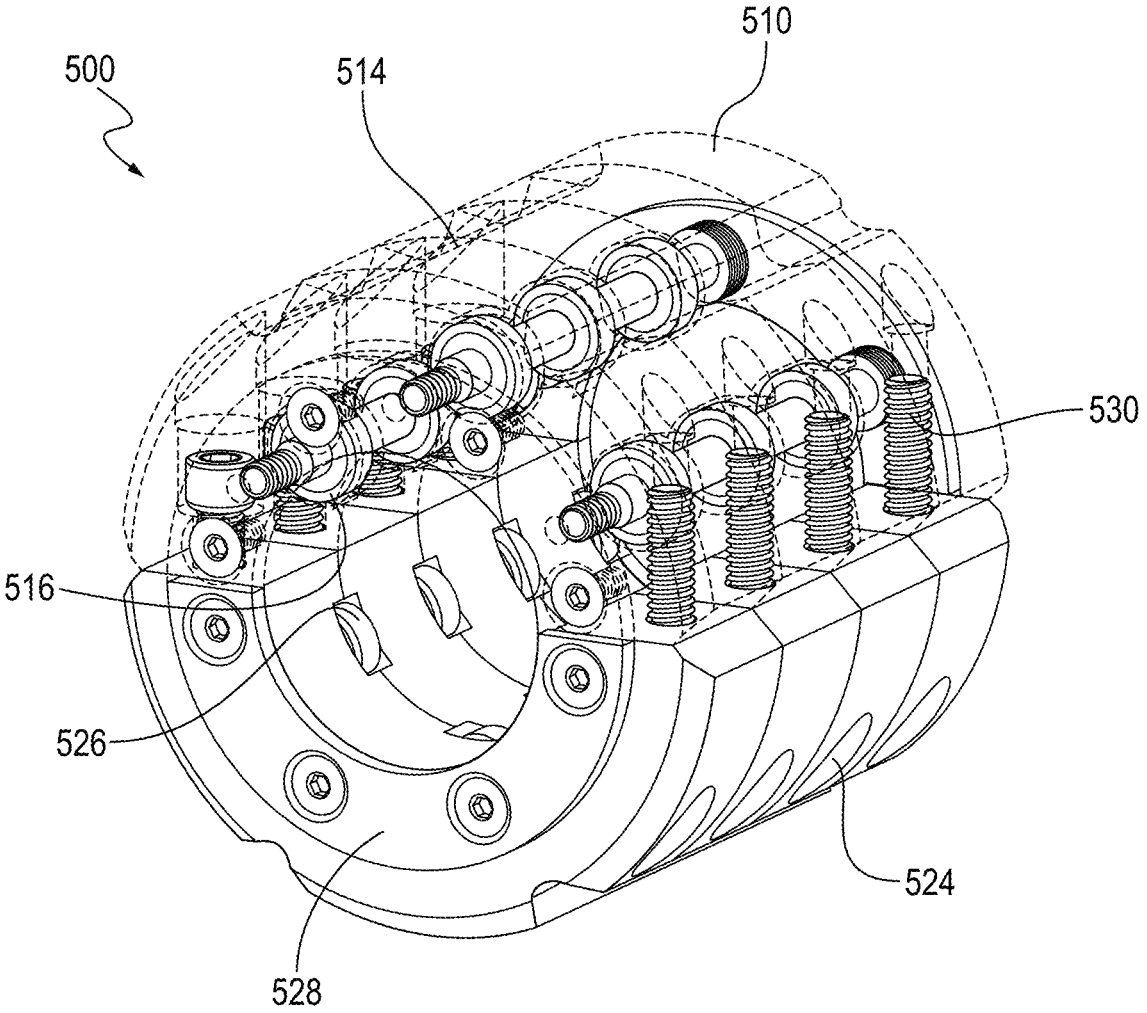
FIG. 7A is another perspective view of the roller body of FIG. 5A. Here, an upper portion (or upper half) of the roller body is transparent, revealing connective hardware.

FIG. 7A is another perspective view of the roller body 500 of FIG. 5A. Here, the upper half 510 of the roller body 500 is transparent, revealing connective hardware.

Figure 7B:
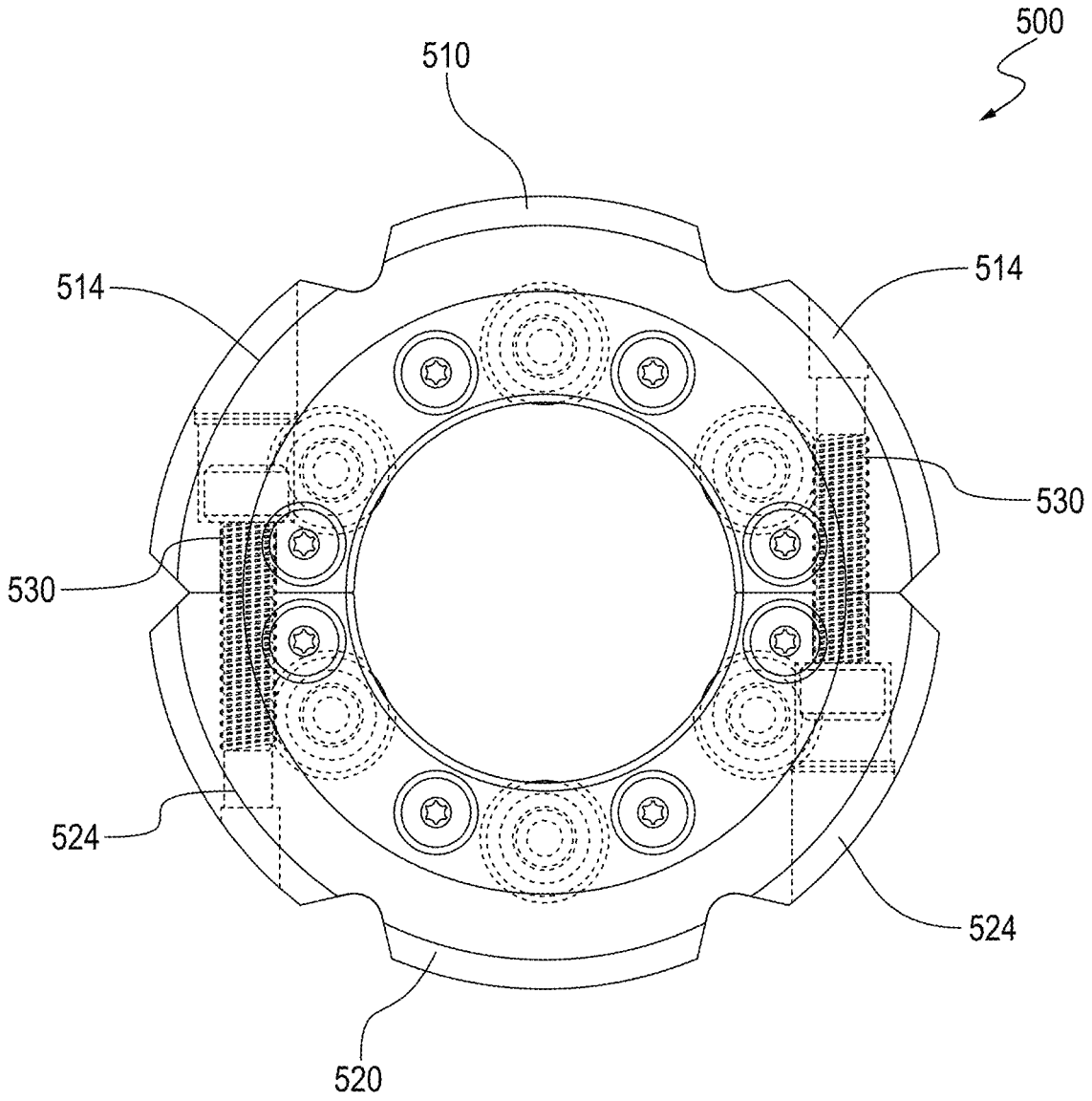
FIG. 7B is an end view of the roller body of FIG. 5A. Both halves of the roller body are transparent, revealing the connective hardware.

FIG. 7B is an end view of the roller body 500 of FIG. 5A. Both halves 510, 520 of the roller body 500 are transparent, revealing connective hardware.

Figure 8A:
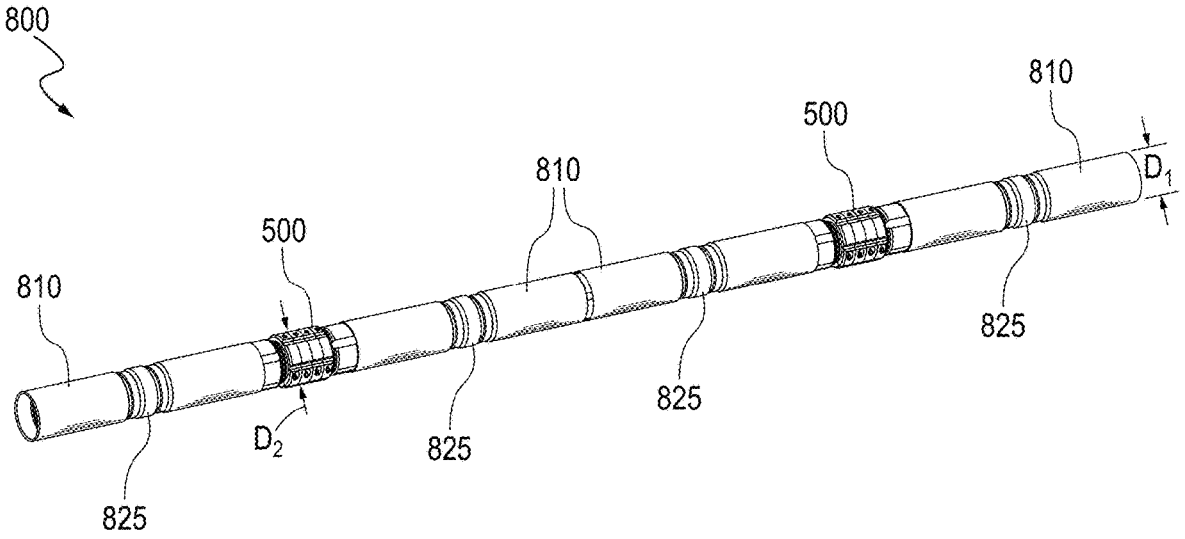
FIG. 8A is a perspective view of a tool string having two roller subs in series with downhole tools. The tool string is able to rotate relative to the two roller subs.

FIG. 8A is a perspective view of a tool string 800. The tool string 800 defines a series of downhole tools 810. The tools 810 in FIG. 8A are shown as being generic. However, it is understood that the tools 810 may be any tool, such as a perforating gun that is run into a horizontal section of a wellbore, such as wellbore 100 of FIG. 1. In the arrangement of FIG. 8A, four gun strings may be visualized as the downhole tools 810.

Along the tool string 800 are two roller bodies 500. The roller subs 600 are placed in series between the downhole tools 810. The roller bodies 500 are intended to be in accordance with the roller sub 500 of FIG. 5A. In this respect, the roller bodies 500 include bearing members 516, 526 that permit the semi-circular discs 512, 522 to rotate about a fixed elongated shaft such as elongated shaft 316 of FIG. 3A.

It is observed that the downhole tools 810 have a first outer diameter, shown as $D_1$. The ends 312, 314 of the roller body 300 create shoulders having the first outer diameter $D_1$. The roller bodies 500 have a second outer diameter, shown as $D_2$. The second outer diameter $D_2$ is greater than the first outer diameter $D_1$. The second outer diameter $D_2$ is configured to closely reside within the inner diameter of the horizontal portion 156 of the production casing 150.

Figure 8B:
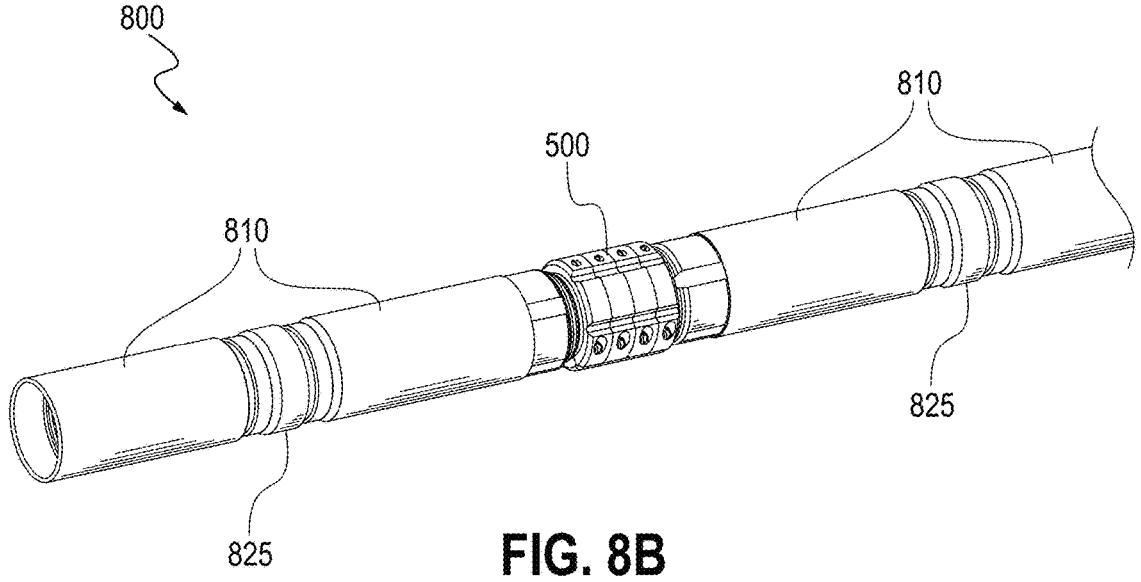
FIG. 8B is an enlarged view of a portion of the tool string of FIG. 8A, showing one of the roller subs with greater clarity.

FIG. 8B is an enlarged view of a portion of the tool string 800 of FIG. 8A. One of the roller bodies 500 is shown with greater clarity. The roller bodies 500 permit the overall tool string 800 to twist within the horizontal section 156 of the production casing 150 without becoming bound up, or torqued. Stated more simply, the roller bodies 500 reduce the rotational friction of the tool string 800 within the horizontal section 156. More importantly, the ability of the tool string 800 to rotate relative to the roller bodies 500 and the surrounding casing 150 keeps the working string (such as wireline 240) from becoming torqued.

The larger O.D. of the roller body 500 can be seen relative to the adjacent downhole tools 810. This allows the weight of the tool string 800 to be placed on the roller bodies 500 when the tool string 800 is horizontal.

In one aspect, a full tool string 800 may look like:

Orienting Weight Bar→Roller Sub Assembly→Orienting Weight Bar→Roller Sub Assembly→Cable Head→Casing Collar Locator→Perforating Gun 1→Roller Sub Assembly→Perforating Guns 2 and 3→Roller Sub Assembly→etc.

Using the tubular body 300 and the roller body 500 (together roller sub 600), a method of running a tool string into a wellbore is provided. The method first comprises providing a wellbore. The wellbore has a deviated section such as the horizontal leg 156 of the wellbore 100 of FIG. 1. The term "providing" may mean that a service company accesses a wellbore that has been drilled by a drilling company and has been at least partially completed by a separate service company.

The method also includes running a tool string into the wellbore. The tool string may comprise:

- a first downhole tool 810;
- a second downhole tool 810; and
- a roller sub 600 residing intermediate the first downhole tool and the second downhole tool.

The roller sub has a tubular body comprising an elongated shaft. The elongated shaft has a first end and an opposing second end. Additionally, the elongated shaft defines a bore extending between the first and second ends. The bore is dimensioned to receive an electrical wire or data cable. Preferably, the elongated shaft is fabricated from steel, titanium, beryllium copper, or a metal alloy thereof.

First threads are provided at the first end of the tubular body for engaging the first downhole tool. Similarly, second threads are provided at the opposing second end for engaging the second downhole tool.

A first shoulder resides proximate the first end of the elongated shaft of the tubular body. Additionally, a second shoulder resides proximate the second end of the elongated shaft of the tubular body. Each of the first shoulder and the second shoulder defines a first outer diameter.

The roller sub also includes a roller body. The roller body is releasably clamped onto the elongated shaft of the cylindrical body between the first shoulder and the second shoulder. The roller body has a second outer diameter that is greater than the first outer diameter, and comprises at least two bearing members. The bearing members permit relative rotational movement between the roller body and the tubular body.

The method further comprises passing the tool string through at least a portion of the deviated section.

In a preferred arrangement, the roller body comprises an upper portion and a lower portion. In one aspect, the upper portion is an upper half portion while the lower portion is a lower half portion. Each of the upper portion and the lower portion comprises a series of semi-circular disks placed in series. Additionally, each of the upper portion and the lower portion comprises a series of openings, with the openings in the upper portion being aligned with the openings in the lower portion. Finally, the roller sub further may comprise a plurality of bolts configured to be received within the openings in the upper portion and the lower portion, and to secure the upper portion to the lower portion.

The method then further comprises clamping the upper portion and the lower portion onto and around the elongated shaft between the first shoulder and the second shoulder. In this way, the roller body is releasably clamped onto the elongated shaft between the two shoulders. The tool string is preferably run into the wellbore at the end of an electric wireline. In this instance, passing the tool string through the deviated section comprises pumping the tool string downhole using hydraulic pressure.

In a preferred embodiment, each of the first and second downhole tools is a perforating gun. In this instance, the tool string is a perforating gun assembly. Each of the first and second downhole tools defines a third outer diameter formed by a respective gun barrel housing, wherein the second outer diameter is also larger than the third outer diameter.

Where the tool string is a perforating gun assembly, the first threads constitute female threads configured to be threaded onto an end of a first male-by-male tandem sub. Similarly, the second threads constitute female threads configured to be threaded into an end of a second male-by-male tandem sub.

In one aspect, a second end of the first male-by-male tandem sub is connected to a first perforating gun. The second threads constitute female threads configured to be threaded into a second end of a second male-by-male tandem sub. Additionally, a second end of the second male-by-male tandem sub may be connected to a second perforating gun.

The disclosed embodiments provide methods and systems for preventing electronics located inside a switch sub from being damaged by detonation of an adjacent perforating gun. It should be understood that this description is not intended to limit the invention; on the contrary, the exemplary embodiments are intended to cover alternatives, modifications, and equivalents, which are included in the spirit and scope of the invention as defined by the appended claims. Further, in the detailed description of the exemplary embodiments, numerous specific details are set forth to provide a comprehensive understanding of the claimed subject matter. However, one skilled in the art would understand that various embodiments may be practiced without such specific details.

Further, variations of the detonation system and of methods for using the detonation system within a wellbore may fall within the spirit of the claims, below. It will be appreciated that the inventions are susceptible to other modifications, variations, and changes without departing from the spirit thereof.

We claim:

1. A roller sub comprising:

a tubular body having:

an elongated shaft having a first end and an opposing second end, with the elongated shaft defining a bore extending between the first and second ends, with the bore being dimensioned to receive an electrical wire or data cable;

first threads provided at the first end for engaging a first wellbore tool;

second threads provided at the opposing second end for engaging a second wellbore tool;

a first shoulder residing proximate the first end of the elongated shaft, and a second shoulder residing proximate the second end of the elongated shaft, wherein each of the first shoulder and the second shoulder defines a first outer diameter; and a roller body releasably clamped onto the elongated shaft of the cylindrical body between the first shoulder and the second shoulder, wherein the roller body:

has a second outer diameter that is greater than the first outer diameter, and comprises at least two bearing members that permit relative rotational movement between the elongated shaft and the surrounding roller body.

2. The roller sub of claim 1, wherein the roller body comprises an upper portion and a lower portion, wherein the upper portion and the lower portion are configured to be clamped together onto and around the elongated shaft between the first shoulder and the second shoulder.

3. The roller sub of claim 2, wherein:

the first threads constitute male threads configured to be threaded onto an end of the first wellbore tool; and the second threads constitute male threads configured to be threaded onto an end of the second wellbore tool.

4. The roller sub of claim 3, wherein:

each of the first and second wellbore tools is a perforating gun, with each perforating gun having a third outer diameter; and the second outer diameter is also larger than the third outer diameter.

5. The roller sub of claim 2, wherein:

the first threads constitute female threads configured to be threaded onto an end of a first male-by-male tandem sub; and the second threads constitute female threads configured to be threaded onto an end of a second male-by-male tandem sub.

6. The roller sub of claim 2, wherein:

the first threads constitute female threads configured to be threaded onto a first end of a first male-by-male tandem sub;

a second end of the first male-by-male tandem sub is connected to a first perforating gun as the first wellbore tool;

the second threads constitute female threads configured to be threaded onto a second end of a second male-by-male tandem sub;

a first end of the second male-by-male tandem sub is connected to a second perforating gun as the second wellbore tool;

each of the first perforating gun and the second perforating gun has a third outer diameter; and the second outer diameter is also larger than the third outer diameter.

7. The roller sub of claim 2, wherein the elongated shaft is fabricated from steel, titanium, beryllium copper, or a metal alloy thereof.

8. The roller sub of claim 2, wherein each of the at least two bearing members comprises a roller bearing residing within the roller body.

9. The roller sub of claim 2, wherein the upper portion is an upper half portion; the lower portion is a lower half portion; each of the upper portion and the lower portion comprises a series of semi-circular disks placed in series; each of the upper portion and the lower portion comprises a series of openings, with the openings in the upper portion being aligned with the openings in the lower portion; and the roller sub further comprises a plurality of bolts configured to be received within the openings in the upper portion and the lower portion, and to secure the upper portion to the lower portion.

10. A method of running a tool string into a wellbore, comprising: providing a wellbore, wherein the wellbore has a deviated section; running a tool string into the wellbore, the tool string comprising: a first downhole tool; a second downhole tool; and a roller sub residing intermediate the first downhole tool and the second downhole tool, and wherein the roller sub comprises: a tubular body having: an elongated shaft having a first end and an opposing second end, with the elongated shaft defining a bore extending between the first and second ends, with the bore being dimensioned to receive an electrical wire or data cable; first threads provided at the first end for engaging the first downhole tool; second threads provided at the opposing second end for engaging the second downhole tool; a first shoulder residing proximate the first end of the elongated shaft, a second shoulder residing proximate the second end of the elongated shaft, wherein each of the first shoulder and the second shoulder defines a first outer diameter; and a roller body releasably clamped onto the elongated shaft of the tubular body between the first shoulder and the second shoulder, wherein the roller body has a second outer diameter that is greater than the first outer diameter, and comprises at least two bearing members that permit relative rotational movement between the elongated shaft and the surrounding roller body; and passing the tool string through at least a portion of the deviated section.

11. The method of claim 10, wherein:

the roller body comprises an upper portion and a lower portion; and the method further comprises clamping the upper portion and the lower portion onto and around the elongated shaft between the first shoulder and the second shoulder.

12. The method of claim 11, wherein:

the tool string is run into the wellbore at the end of an electric wireline; and passing the tool string through the deviated section comprises pumping the tool string downhole using hydraulic pressure.

13. The method of claim 12, wherein:

each of the first and second downhole tools is a perforating gun;

the tool string is a perforating gun assembly;

each of the first and second downhole tools defines a third outer diameter formed by a respective gun barrel housing; and the second outer diameter is also larger than the third outer diameter.

14. The method of claim 13, wherein:

the first threads constitute female threads threaded onto an end of a first male-by-male tandem sub; and the second threads constitute female threads threaded onto an end of a second male-by-male tandem sub.

15. The method of claim 14, wherein:

a second end of the first male-by-male tandem sub is connected to the first perforating gun; and a second end of the second male-by-male tandem sub is connected to the second perforating gun.

16. The method of claim 13, wherein the elongated shaft is fabricated from steel, titanium, beryllium copper, or a metal alloy thereof.

17. The method of claim 13, wherein each of the at least two bearing members comprises (i) a roller bearing residing within the roller body, or (ii) a disc.

18. The method of claim 13, wherein the upper portion is an upper half portion;

the lower portion is a lower half portion;

each of the upper portion and the lower portion comprises a series of semi-circular disks placed in series;

each of the upper portion and the lower portion comprises a series of openings, with the openings in the upper portion being aligned with the openings in the lower portion; and the roller sub further comprises a plurality of bolts configured to be received within the openings in the upper portion and the lower portion, and to secure the upper portion to the lower portion.

19. A method of running a tool string into a wellbore, comprising: providing a wellbore, wherein the wellbore has an inner diameter and a deviated section; lowering a tool string into the wellbore at the end of a wireline, the tool string comprising: a first downhole tool; a second downhole tool; and a roller sub residing intermediate the first downhole tool and the second downhole tool, wherein the roller sub comprises:

a tubular body having: an elongated shaft having a first end and an opposing second end, with the elongated shaft defining a bore extending between the first and second ends, with the bore being dimensioned to receive an electrical wire or data cable, first threads provided at the first end for engaging the first downhole tool; second threads provided at the opposing second end for engaging the second downhole tool: a first shoulder residing proximate the first end of the elongated shaft: a second shoulder residing proximate the second end of the elongated shaft, wherein each of the first shoulder and the second shoulder defines a first outer diameter; and a roller body releasably clamped onto the elongated shaft of the tubular body between the first shoulder and the second shoulder; and wherein the roller body has a second outer diameter that is greater than the first outer diameter, and comprises at least two bearing members that permit relative rotational movement between the (1) the wireline, the elongated shaft, and the first and second downhole tools, and (1i) the surrounding roller body: pumping the tool string into a deviated section of the wellbore; and allowing the wireline and the first and second downhole tools to rotate within the wellbore along the inner diameter, thereby relieving torque within the wireline.

* * * * *